United States Patent [19]

Wright et al.

[11] 4,253,225

[45] Mar. 3, 1981

[54] METHOD OF MANUFACTURING A HEAT EXCHANGER ELEMENT

[75] Inventors: William E. Wright, East Syracuse; Ross Moyer, Lafayette, both of N.Y.

[73] Assignee: Carrier Corporation, Syracuse, N.Y.

[21] Appl. No.: 83,723

[22] Filed: Oct. 10, 1979

[51] Int. Cl.[3] ..... B23P 15/26

[52] U.S. Cl. ..... 29/157.3 R; 165/163; 165/175

[58] Field of Search ..... 29/157.3 R, 157.3 A; 113/118 A, 118 B; 165/163, 175

[56] References Cited

U.S. PATENT DOCUMENTS

| | | | |
|---|---|---|---|
| 1,800,329 | 4/1931 | Uhde | 165/163 |
| 1,893,330 | 1/1933 | Jones | 29/157.3 R |
| 1,926,342 | 9/1933 | Lippencott | 165/163 |
| 2,137,044 | 11/1938 | Dawson | 29/157.3 R |
| 2,697,868 | 12/1954 | Arant | 29/157.3 R |
| 3,267,997 | 8/1966 | Matarese et al. | 29/157.3 R |
| 3,639,963 | 2/1972 | Maher | 29/157.3 R |
| 3,785,171 | 1/1974 | Beranek | 29/157.3 R |

*Primary Examiner*—Francis S. Husar
*Assistant Examiner*—V. K. Rising
*Attorney, Agent, or Firm*—J. Raymond Curtin; Donald F. Daley

[57] ABSTRACT

Method of manufacturing a heat exchanger element with a plurality of helically wound coils. The tubes are wrapped about a forming drum in a parallel abutting relation to each other to form a plurality of helically wound coils. Terminal leads are provided at each end of the coil. Terminal leads at each end of the coils are bent, disposed one inwardly the other so that they are positioned tangent to the same plane, which is perpendicular to the center longitudinal axis of the coils, and then a portion of each terminal lead is cut off and joined to a header.

2 Claims, 4 Drawing Figures

METHOD OF MANUFACTURING A HEAT EXCHANGER ELEMENT

BACKGROUND OF THE INVENTION

1. Field of the Invention

This invention relates to heat exchangers which are used in air conditioning and refrigeration industry and are adapted to transfer heat energy between a fluid flowing through the heat exchanger and a gas in contact with the external surface of the heat exchanger. More particularly the invention relates to a method of manufacture of multiple circuit heat exchanger coils which can be utilized alternately as an evaporator or as a condenser in heat pump systems.

2. Description of the Prior Art

Heat pump systems normally comprise an indoor heat exchanger or coil which acts as an evaporator during operation of the systems for cooling purposes, and an outdoor heat exchanger or coil which, at the same time, acts as a condenser.

Some applications of air conditioning or heat pump systems require a large heat exchanger capacity. To provide sufficient and effective cooling or heating of the large interior spaces of buildings it is required to utilize large amounts of refrigerant flowing through the heat exchangers to enhance the heat transfer characteristics. This requires a greater heat exchanger surface which normally is attained by long lengths of tubing, or a larger size tubing.

A plurality of helical tubes of smaller diameter, wound in series, with sufficient amount of surface and pressure drop to assure that the refrigerant is evaporated or condensed have been used. This approach requires inlets and outlets for the refrigerant mounted in the middle of the coil. This type of arrangement is expensive and difficult in assemblying the coils in the casing of the heat exchanger.

Utilization of a plurality of helical coils wound in parallel and interwoven in the same directions provides efficient heat transfer along the whole path of refrigerant through the coils and allows to reduce the length of casing of the heat exchanger particularly where the use of less space is important. Double or multiple coils include a double or multiple lead at each end of the heat exchange element. In making the heat exchange element of the foregoing type two or more tubes are wrapped around the forming drum in parallel contiguous position. After removing the forming drum the ends of the tubes forming the leads of the coils have been cut off to provide the element of desired length. By merely cutting the ends of the tubes off a large gap between the ends and the wound turns of the tubes will result if both leads are terminated at the same point. This gap increases the length of the heat exchange element which is not desirable in the installations where the space is an important factor.

SUMMARY OF THE INVENTION

It is an object of the present invention to provide an improved method of manufacture of multiple coil heat exchanger.

Another object of the present invention is to provide a cheap, economical, efficient and reliable method of manufacturing multiple lead helical coils.

The preceding objects are achieved according to the present invention by bending terminal leads at each end of the multiple helical coil and locating one of the terminal leads of one of the coils inwardly of the other terminal lead of the other coil disposed in parallel with the first coil. Both leads are positioned tangent to the same plane which is perpendicular to the longitudinal axis of the helical coils and subjecte to be cut off.

DESCRIPTION OF THE PREFERRED EMBODIMENT

Figure 1:
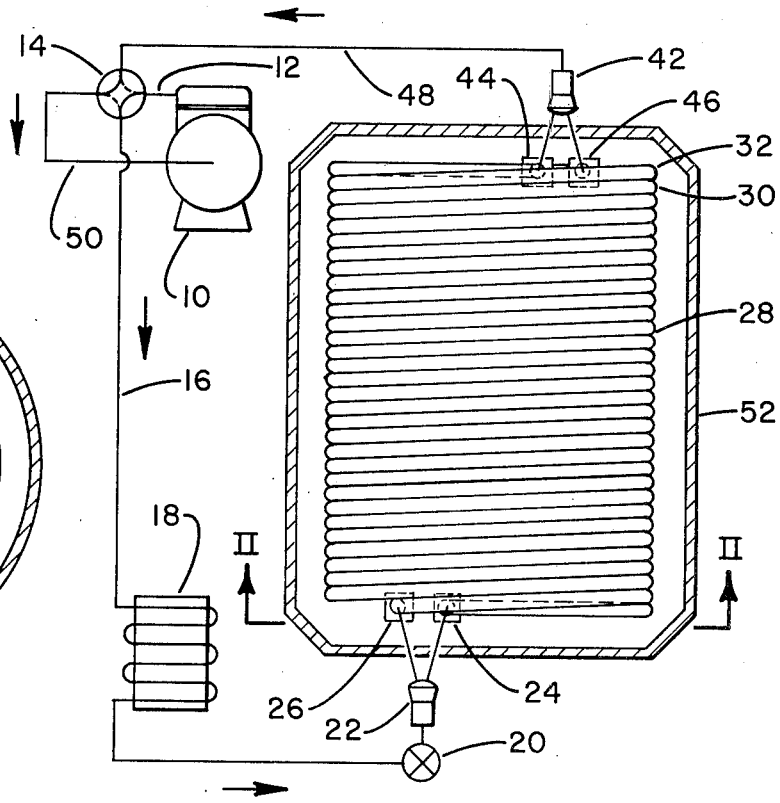
FIG. 1 shows a heat exchanger construction, in cross-section and also includes a schematic representation of a reverse cycle refrigeration system.

Referring to the FIG. 1, there is shown a heat pump unit operable on the reverse cycle principle. A compressor 10 is connected by its discharge line 12 to a conventional reversing valve 14. During the cooling mode of operation the valve 14 is adjusted to direct the refrigerant through a conduit 16 to the outdoor heat exchanger 18 being used as a condenser. The refrigerant then flows through the capillary tubes 20 to a refrigerant collector 22 of the indoor heat exchanger 28 used as an evaporator during the cooling season. The arrows along the tubing illustrate the direction of the flow of refrigerant when the indoor heat exchanger is used as an evaporator. Heat exchanger 18 shown schematically in the drawing is of the same structure as heat exchanger 28. The indoor and outdoor heat exchangers according to the invention each comprise a first helically wound coil 30 and a second helically wound coil 32, interwoven between each turn of the first coil. Coils 30 and 32 are wound in the same direction and form a double circuit unit. Both of the coils 30 and 32 are arranged in interleaved contiguous relation to each other so that air drawn through the unit is evenly distributed between the coils. The terminal leads 34 and 36 of the coils 30 and 32 at the lower side of the heat exchanger may form the inlets of the heat exchanger during the cooling season and outlets during the heating cycle of operation. The terminal leads 38 and 40 of the coils 30 and 32 may form the outlets of the heat exchanger during the cooling season and the inlets during the heating season respectively. Terminal leads 34 and 36 are connected through headers 24 and 26 to the refrigerant collector 22. Terminal leads 38 and 40 are connected to headers 44 and 46 which in turn are connected to a collector 42 joined with a conduit 48 leading to the reversing valve 14. During the cooling season the refrigerant evaporated in the heat exchanger 28 flows through the conduit 48 and valve 14 to a suction line 50 of the compressor. Two coils 30 and 32 are disposed in close adjacent relation to each other and form two parallel circuits suitable for receiving the refrigerant.

Each coil may be formed of any suitable material, such as, for example, aluminum or copper, and preferably consist of a simple, unitary tubular member. The tubes can be provided by conventional fins comprising a plurality of heat conductive metal sheets. Coils 30 and 32 form a double refrigerant flow path through a heat transfer element 28. Double circuit heat transfer element 28 is positioned within a shell 52.

In operation, the refrigerant from header 22 enters the headers 24 and 26, passes simultaneously the coils 30 and 32 and is discharged from the headers 44 and 46 to the collector 42. A relatively warm medium is passed over the coils 30 and 32 to be cooled by passing in heat transfer relation with the relatively cold refrigerant passing through the coils. The refrigerant entering two coils 30 and 32 simultaneously is exposed to the same pressure drop and temperature along the length of the shell 52 in both refrigerant circuits in the heat exchanger. This provides the same rates of heat exchange in both coils along the length of the coils while the refrigerant is flowing through the coils. The two different circuits 30 and 32 are exposed to the same conditions of air flow and heat transfer. Utilization of multiple circuit coil of the foregoing structure provides a larger surface area in a heat transfer element thereby permitting a larger amount of refrigerant through the heat exchanger.

Figure 3:
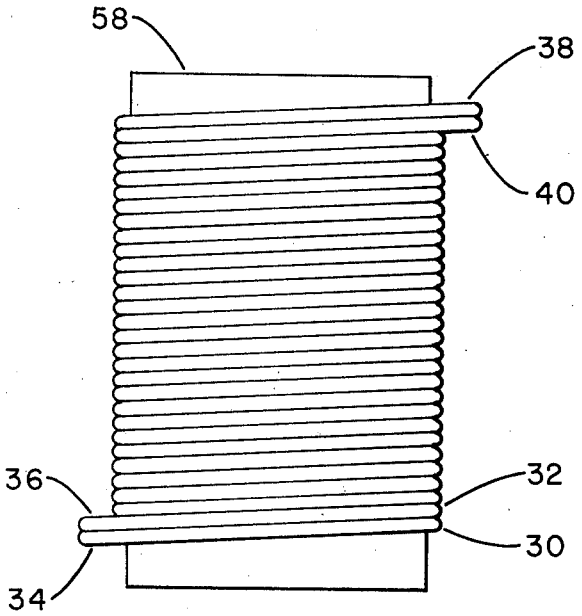
FIG. 3 shows a method of manufacturing the double circuit helical coil.
Figure 4:
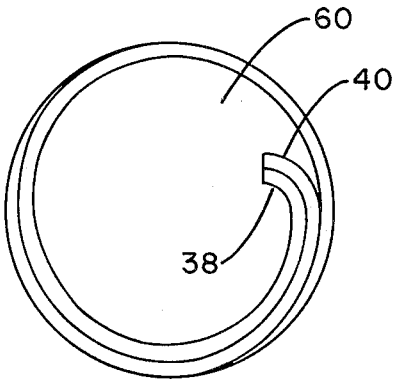
FIG. 4 is a radial view of double circuit helical coil illustrating the end treatment of the coils according to the present invention.
Figure 2:
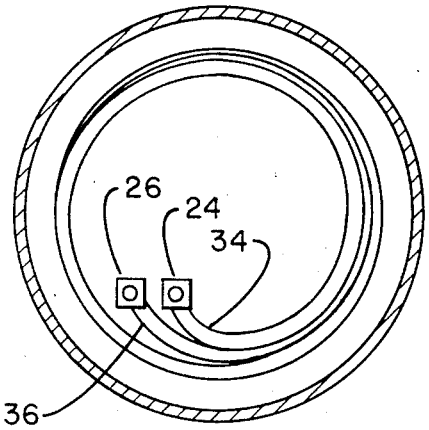
FIG. 2 is a cross-sectional view of FIG. 2 taken along line II—II.

In making the heat exchange element in accordance with the present invention which is illustrated in FIGS. 3 and 4, two tubes are wrapped around the same forming drum 58 in the same direction to form two parallel helically wound coils 30 and 32. Coils 30 and 32 are positioned in abutting relation to each other to provide two parallel circuits for receiving the refrigerant. After wrapping coils 30 and 32 around the forming drum, the tubes of the desired length are preliminarily cut off at each end thereof and drum 58 is removed. The terminal leads 34, 36 and 38, 40 are terminated at the same point respectively forming a double lead at each end of the heat exchange element. To avoid the large gap that will result when the leads are terminated, the following end treatment is proposed. As shown in FIG. 4, the first of the double leads 38 is bent inward of the second lead 40 which also is bent lacing the first lead. Both terminal leads in the bent position are disposed tangent to the same plane 60. This plane is perpendicular to the longitudinal axis of the wound coils 30 and 32. When the double lead tubes are running parallel, the ends of the leads are cut off finally. Terminal leads 34 and 36 are subjected to the same end treatment as leads 38 and 40. The terminal leads are joined with the headers in any conventional manner as for example by welding as shown in FIG. 2. It should be noted that any conventional cutting off of the tubing ends of the coils can be applied. The novel method of manufacturing of the multiple coil heat exchange element is simple, efficient and ease of manufacture.

While this invention has been illustrated in accordance with a preferred embodiment it is recognized that variations and changes may be made therein without departing from the invention as set forth in the claim.

I claim:

1. A method of manufacturing a heat transfer element for use in a heat exchanger wherein air or other fluid is moved in contact with tubes containing refrigerant comprising:

wrapping a plurality of tubes about a forming drum in a parallel abutting position to form a plurality of helically wound coils, providing terminal leads at each end of said coils, removing the wound coils from the forming drum, bending said terminal leads toward the center longitudinal axis of said coils, locating each terminal lead in a bent position inward of the next terminal lead at each end of said coils so that said terminal leads are positioned tangent to a plane which is perpendicular to the center longitudinal axis of said helical coils, cutting off a desired portion of said terminal leads, and joining each end of said terminal leads to a header adapted to supply refrigerant to said heat transfer element.

2. A method of manufacturing a heat transfer element for use in a heat exchanger wherein air or other fluid is moved in contact with tubes containing refrigerant comprising:

wrapping two tubes about a forming drum in a parallel abutting position to form two helically interwound coils, providing terminal leads at each end of said coils, removing the wound coils from the forming drum, bending each of said terminal leads toward the center longitudinal axis of said coils, locating one terminal lead of one coil inward of the terminal lead of the second coil at each end of the coils so that said terminal leads in a bent position are positioned tangent to a plane which is perpendicular to the center longitudinal axis of said helical coils, cutting off a desired portion of each terminal lead, and joining each end of said terminal leads to a header adapted to supply refrigerant to said heat transfer element.

* * * * *